US005440991A

United States Patent [19]

Lewis et al.

[11] Patent Number: 5,440,991

[45] Date of Patent: Aug. 15, 1995

[54] MINIATURE SELF CONTAINED FIRING SYSTEM

[75] Inventors: Donald J. Lewis, Scottsdale; Larry LaClair, Mayer, both of Ariz.

[73] Assignee: Universal Propulsion Company, Inc., Phoenix, Ariz.

[21] Appl. No.: 174,844

[22] Filed: Dec. 29, 1993

[51] Int. Cl.[6] ..... F42C 11/06

[52] U.S. Cl. ..... 102/218; 361/251

[58] Field of Search ..... 102/200, 202.5, 206, 102/218; 361/251

[56] References Cited

U.S. PATENT DOCUMENTS

| | | | |
|---|---|---|---|
| 3,088,409 | 5/1963 | Yavelberg | 102/218 |
| 4,296,688 | 10/1981 | Orlandi | 102/218 |
| 5,031,537 | 7/1991 | Taylor | 102/218 |
| 5,335,598 | 8/1994 | Lewis et al. | 102/218 |

*Primary Examiner*—Ian J. Lobo

*Attorney, Agent, or Firm*—Ellsworth R. Roston; Charles H. Schwartz

[57] ABSTRACT

Each of first and second switches, preferably ganged, have first and second operative relationships. In the first operative relationship, the first switch is connected across a firing device to prevent the firing device from being energized. In the first operative relationship, the second switch is connected across an energy storage device (e.g. capacitor) to prevent the capacitor from being charged. In the second operative relationship of the second switch, the capacitor is charged by an energy supply device (e.g. battery). In the second operative relationship of the first and second switches, the capacitor is connected in a circuit with the first device and a third switch (e.g. transistor). The transistor is normally nonconductive to prevent the capacitor from discharging through the firing device with the first and second switches in the second operative relationships. When the transistor becomes conductive with the first and second switches in the second operative relationship, the capacitor discharges and fires the firing device. The transistor becomes conductive when a triggering signal is introduced to a pair of terminals. The triggering signal may be filtered by a low pass filter (e.g. inductance and capacitance) to prevent noise from passing. A device (e.g. zener diode) limits the triggering signal amplitude. The filtered triggering signal charges the capacitance in the low pass filter. The capacitor charge causes a second transistor to become conductive, thereby producing a voltage across an impedance. This voltage triggers the first transistor to the conductive state to provide for the firing of the firing device.

25 Claims, 1 Drawing Sheet

MINIATURE SELF CONTAINED FIRING SYSTEM

Figure 1:
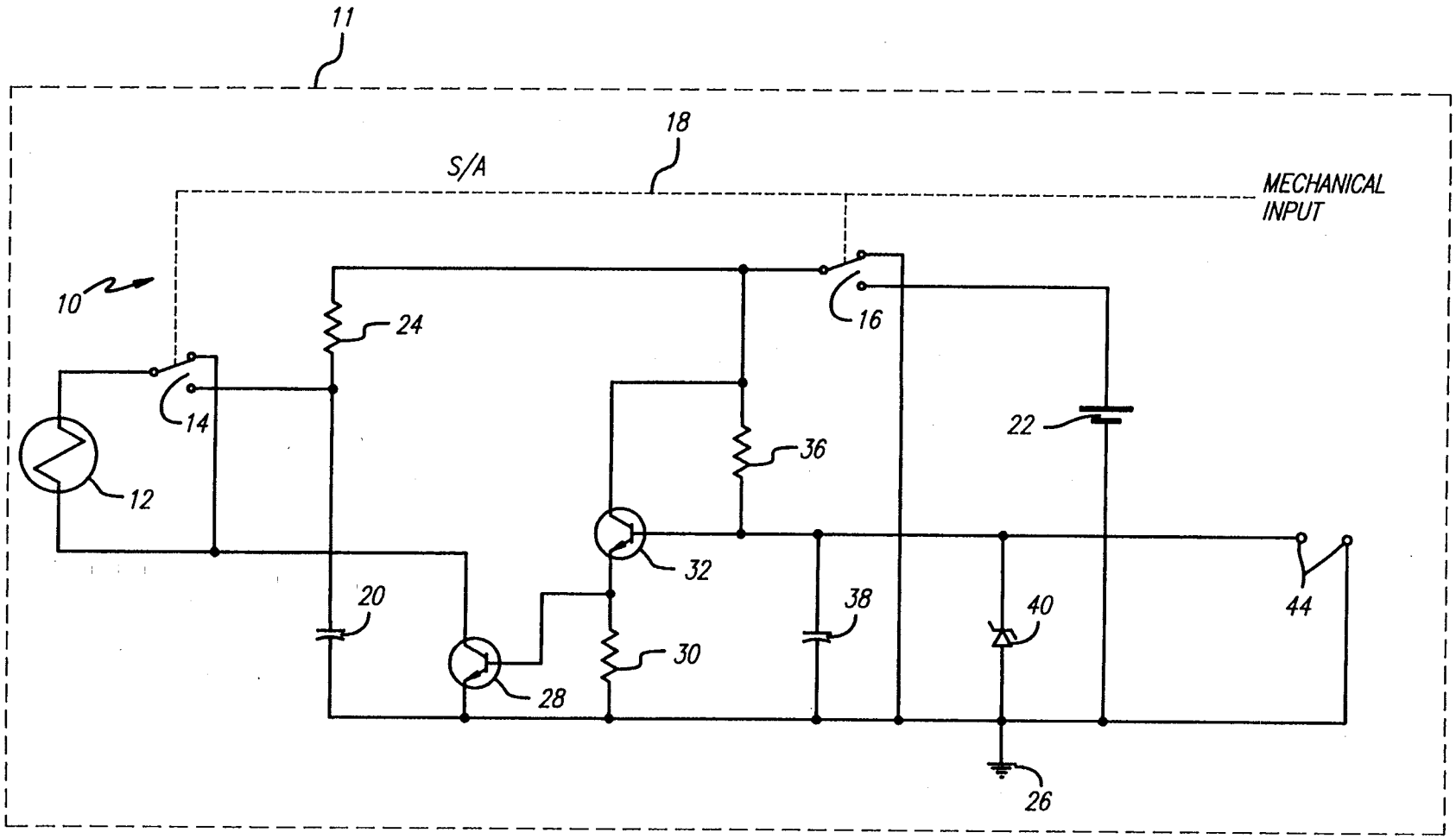

This invention relates to a circuit for energizing a firing device. The invention also relates to a self-contained firing circuit which provides a number of fail-safe features to prevent the circuit from energizing the firing device until all of the fail-safe features have been met. The invention additionally relates to a firing circuit which requires a low amount of energy, even with all of the fail-safe features, to energize the firing device.

Ordnance systems generally have at least two (2) separate units: (1) an input mechanism for initiating a firing of a firing device such as a squib and (2) an output mechanism operated as a result of the firing device such as the squib. The input mechanism may take any one (1) of several different forms, all known in the prior art. For example, the input unit may constitute (a) a gas input or a detonation unit, (b) a mechanized unit such as a lanyard, (c) an electrical input such as an electrical current, (d) an input based upon the attainment of a particular temperature or (e) an input based upon a particular pressure. The output unit may also have a number of different forms, all known in the prior art. For example, the output unit may constitute a cutter for a reefing line or may provide heat from a thermal battery.

Systems have been provided in the prior art for activating the firing device when the input mechanism has been actuated. Such systems have generally been chemical, not electronic. They have had certain significant disadvantages. They have not been reliable, since they have sometimes fired at unexpected times or at times considerably affected by the temperature at the time of operation. They have tended to deteriorate with time so that they have sometimes not fired at all or, if they fired, at times significantly different from the defined times. They have also required large amounts of power to operate and to activate the firing device such as the squib. They have not protected the system from firing the firing device at undesirable times by providing safeguards at such undesirable times at all of the points in the system where the system was vulnerable to produce a firing.

The disadvantages discussed above have been known for some time. A considerable amount of effort has been devoted, and significant amounts of money have been expended, to provide systems which activate a firing device such as a squib and which eliminate the disadvantages discussed above. However, the systems now in use still have the disadvantages discussed above.

This invention provides a system which overcomes the above disadvantages. The system of this invention is reliable in that it activates a firing device only when it is expected to activate the firing device. For example, the firing device in the system of this invention is short circuited until the system is ready to activate the firing device. The system is also reliable in that its timing accuracy does not deteriorate significantly with time. These advantages result in part from the fact that the system is electronic. The system of this invention is also advantageous in that it is self contained (with its own energy source such as a lithium battery with a long life and with a capability over a wide range of temperatures) and in that it requires a very low amount of energy to activate the firing device. Furthermore, the system responds only to triggering signals, and not to electrical noise, to activate the firing device. This results in part from the complete Faraday shielding and from the internal filtering in the system.

In one embodiment of the invention, each of first and second switches, preferably ganged, have first and second operative relationships. In the first operative relationship, the first switch is connected across a firing device to prevent the firing device from being energized. In the first operative relationship, the second switch is connected across an energy storage device (e.g. capacitor) to prevent the capacitor from being charged. In the second operative relationship of the second switch, the capacitor is charged by an energy supply device (e.g. battery).

In the second operative relationship of the first and second switches, the capacitor is connected in a circuit with the firing device and a third switch (e.g. transistor). The transistor is normally non-conductive to prevent the capacitor from discharging through the firing device with the first and second switches in the second operative relationships. When the transistor becomes conductive with the first and second switches in the second operative relationship, the capacitor discharges through the firing device to fire the firing device. The transistor becomes conductive when a triggering signal is introduced to a pair of terminals.

The triggering signal may be filtered by a low pass filter (e.g. inductance and capacitance) to prevent noise from passing. Finite filtering may also be employed. A device (e.g. zener diode) limits the triggering signal amplitude. The filtered triggering signal charges the capacitance in the low pass filter. The capacitor charge causes a second transistor to become conductive, thereby producing a voltage across an impedance. This voltage triggers the first transistor to the conductive state to provide for the firing of the firing device.

In the drawing:

The single Figure is a circuit diagram of one embodiment of the invention.

The single Figure shows a circuit generally indicated at 10 for firing a firing device 12 such as a squib. The circuit 10 may be disposed in a Faraday shield, indicated in broken lines at 11, to shield the circuit from being affected by external noise. A switching device 14 having first and second operative relationships is connected across the firing device 12 in the first operative relationship. For example, the switch 14 may be a mechanical switch having a movable arm and a pair of stationary contacts. When the movable arm of the switch 14 engages the upper stationary contact of the switch, the switch is connected across the firing device 12 to prevent the device from firing. This relationship is shown in the single Figure.

A switch 16 is preferably ganged to the switch 14 as indicated by broken lines 18 between the movable arms of the switches. When the movable arm of the switch 16 engages the upper stationary contact of the switch, the switch is connected across an energy storage device such as a capacitor 20 to prevent the capacitor from being charged. This relationship is shown in the single Figure. The capacitor 20 may be a tantalum capacitor with a suitable value such as approximately 68 microfarads. The capacitor 20 preferably has a low internal resistance.

When the movable arm of the switch 16 engages the lower stationary contact of the switch, a series circuit is formed which includes an energy supply device such as a battery 22, a resistor 24 and the capacitor 20. The battery 22 may have a suitable value such as approximately two and one half volts (2.5 V). The resistor 24 may have a suitable value such as approximately 383 ohms. One terminal of each of the capacitor 20 and the battery 22 may be at a reference potential such as ground 26.

The lower terminal of the switch 14 is connected to the terminal common to the resistor 24 and the capacitor 20. The upper terminal of the switch 14 is common with one terminal of a switching device such as the collector of a transistor 28. The transistor 28 is preferably a bi-polar npn transistor. The emitter of the transistor 28 is at the reference potential such as ground 26. A resistor 30 having a suitable value such as approximately two hundred thousand ohms (200,000 Ω) is connected between the base of the transistor 28 and the ground 26.

An additional switch such as a transistor 32 is included in the circuit 10. The transistor 32 may be a bi-polar transistor of the npn type. A connection is made between the base of the transistor 30 and the emitter of the transistor 32. The base of the transistor 32 is connected to one terminal of a resistor 36 and the collector of the transistor 32 is common with the other terminal of the resistor and with the movable arm of the switch 16. The resistor 36 may have a suitable value such as approximately two hundred thousand ohms (200,000 Ω). A capacitor 38 having a suitable value such as approximately 0.027 μF extends electrically from the base of the transistor 32 to ground. A voltage-regulating device such as a zener diode 40 is in parallel with the capacitor 38.

When the movable arms of the switches 14 and 16 engage the upper stationary contacts of the switches, this prevents the firing device 12 from being energized and the capacitor 20 from being charged. Since the switches 14 and 18 are preferably ganged, the movable arms of the switches simultaneously engage the lower stationary contacts of the switches when the switches are actuated. The mechanical force for actuating the movable arms of the switches 14 and 18 to engage the lower stationary contacts of the switches may be provided by a number of different sources, all of them well known in the art. For example, the mechanical force can be generated from a mass spring arrangement which responds to a "G" force of at least a particular minimum value. Alternatively, the force for moving the arms of the switches 14 and 16 into engagement with the lower stationary contacts of the switches can be generated from a temperature sensing bi-metallic device or a thermoplastic phase change material or from an electrical reaction.

When the movable arm of the switch 16 engages the lower stationary contact, the battery 22 charges the capacitor 20 through a circuit including the battery, the resistor 24 and the capacitor. This charge is relatively fast because the resistor and the capacitor have relatively low values. For example, the capacitor 20 may be charged in less than one tenth of a second (0.1 sec.). The capacitor 20 is then ready to activate the firing device 12 through a circuit including the capacitor, the movable arm and lower stationary contact of the switch 14, the firing device and the transistor 28 when the transistor becomes conductive.

A triggering signal may be introduced between the terminals 44 after the capacitor 20 has become charged. This triggering signal passes through the low pass filter defined by the capacitor 38. This filter operates to eliminate noise since noise generally occurs at high frequencies. The capacitor also operates to store a charge related to the amplitude of the triggering signal. The amplitude of the triggering signal is regulated by the zener diode 40 to a maximum amplitude of a particular value.

When the movable arm of the switch 16 engages the lower stationary contact of the switch, the capacitor 38 becomes charged through a circuit including the battery 22, the switch 16, the resistor 36 and the capacitor. This charge occurs during the time that the capacitor 20 is being charged. The charge in the capacitor 38 is not sufficient to trigger the normally non-conductive transistor 32 to a state of conductivity. The charge produced in the capacitor 38 by the triggering signal between the terminals 44 is introduced to the base of the transistor 32 to increase the charge in the capacitor. This increased charge is sufficient to produce a state of conductivity in the transistor 32. The duration of this state of conductivity in the transistor 32 is increased because of the charge in the capacitor 38.

When the transistor 32 becomes conductive, current flows through a circuit including the battery 22, the lower stationary contact and the movable arm of the switch 16, the transistor 32 and the resistor 30. The resultant voltage across the resistor 30 causes the normally non-conductive transistor 28 to become conductive. This establishes a low impedance path through the capacitor 20, the switch 14, the firing device 12 and the transistor 28. The firing device 12 accordingly becomes activated or fired.

With a value of two and one half volts (2.5 V.) in the battery 22, the stored energy in the capacitor 20 is approximately two thousand (2000) ergs when the capacitor is a tantalum capacitor with a value of approximately sixty six microfarads (2000 μf.). The transistor 28 has a forward voltage drop of approximately twenty nine hundredths of a volt (0.29 V.). This reduces the actual capacitor voltage to approximately 1563 ergs of stored energy. Since only approximately five hundred (500) ergs are needed to activate or fire the firing device 12, there is a 3:1 safety factor in the amount of energy provided to the amount of energy needed. Thus, the system of this invention is able to operate with a minimal voltage from the battery 22 to activate or fire the firing device 12.

The system of this invention has certain important advantages. It prevents the capacitor 20 from being charged and the firing device 12 from being activated until an input mechanism has actuated the switches 14 and 16. Thereafter, the system becomes armed almost instantaneously (e.g. 0.1 seconds) by the charging of the capacitors 20 and 38. When a triggering signal is thereafter introduced between the terminals 44, the firing device becomes instantaneously activated. The system is self contained. Furthermore, the energy needed in the self contained system to fire the device 12 is minimal. This allows the energy storage member such as the battery 22 to have a relatively low value such as approximately two and one half (2.5) volts.

Certain applications filed individually in the name of one or both inventors and assigned of record to the assignee of record of this application may be considered to be related to this application. These constitute 1. Application Ser. No. 08/059,450 filed May 7, 1993, for "Timing and Firing Circuitry" in the names of Donald J. Lewis and Larry LaClair as joint inventors.

2. Application Ser. No. 08/141,260 filed Oct. 22, 1993, for "Delay Ordnance System" in the name of Donald J. Lewis as a sole inventor.

3. Application Ser. No. 08/143,255 filed Oct. 22, 1993, for "Self-Powered Delay Ordnance" in the names of Donald J. Lewis and Larry LaClair as joint inventors.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. In combination, firing means having properties of being fired upon the receipt of energy, energy storage means for storing and discharging energy, energy supply means, first switching means having first and second operative relationships and operative in the first relationship for short circuiting the firing means and the energy storage means and operative in the second relationship to provide for a charging of the energy storage means from the energy supply means and subsequently to discharge the energy in the energy storage means through the firing means, second switching means having first and second operative relationships and normally operative in the first relationship to provide an open circuit to the energy storage means and the firing means and operative in the second relationship to complete a circuit for the firing of the firing means by the energy in the energy storage means, and triggering means including a low pass filter for introducing a triggering signal to the second switching means to obtain an operation of the second switching means in the second operative relationship.

2. In a combination as set forth in claim 1 wherein the triggering means includes terminals for receiving a triggering pulse and a low pass filter for filtering noise and for passing only pulses of low frequency to the second switching means.

3. In a combination as set forth in claim 2 wherein the triggering means include a pair of terminals for receiving a triggering pulse and wherein the low pass filter in the triggering means includes a capacitance in parallel with the terminals.

4. In a combination as set forth in claim 1 wherein the energy supply means includes a battery.

5. In combination, firing means having properties of being fired upon the receipt of electrical energy, first switching means having first and second operative relationships and operative in the first relationship for short circuiting the firing means, energy supply means, energy storage means, second switching means having first and second operative relationships and operative in the first relationship for short circuiting the energy storage means and operative in the second relationship to provide for the passage of energy from the energy supply means to the energy storage means for the storage of such energy in the energy storage means, third switching means having first and second operative relationship and normally operative in the first relationship to provide a high impedance to the firing means and the energy storage means to prevent the energy storage means from discharging through the firing means and operative in the second relationship to provide a low impedance path for the discharge of the energy in the energy storage means through the firing means, first means for initially providing for a change in the first and second switching means from the first operative relationships to the second operative relationships, and second means for subsequently introducing a triggering pulse to the third switching means to provide for a change in the third switching means from the first operative relationship to the second operative relationship.

6. In a combination as set forth in claim 5, the energy supply means constituting a battery, the first and second switching means being ganged.

7. In a combination as set forth in claim 5, the second means including third means for preventing noise from changing the third switching means from the first operative relationship to the second operative relationship.

8. In a combination as set forth in claim 7, the energy supply means constituting a battery, the first and second switching means being ganged.

9. In a combination as set forth in claim 5, the third means including a pair of terminals for receiving an input pulse and means including a capacitance connected between the terminals for providing a low pass filter for the triggering of the third switching means to the second operative relationship only in accordance with the introduction of the input pulse to the terminals.

10. In combination, firing means having properties of being fired upon the introduction of energy to the firing means, energy storage means, energy supply means, first switching means having first and second operative relationships and operative in the first relationship to prevent the firing means and the energy storage means from receiving energy and operative in the second relationship to provide for the introduction of energy to the energy storage means and the passage of the energy in the energy storage means to the firing means, second switching means having first and second operative relationships and connected in a circuit with the firing means and the energy storage means in the second operative relationship of the first switching means and providing a high impedance in the circuit in the first operative relationship and providing a low impedance in the circuit in the second relationship, first means for providing a triggering signal, second means for providing a low pass filter for the triggering signal, and third means connected in a circuit with the second switching means and the energy supply means and responsive to the triggering signal after the passage of the triggering signal through the second means for changing the second switching means from the first operative relationship to the second operative relationship.

11. In a combination as set forth in claim 10,
the second means including a capacitance connected to the first means for providing the low pass filter.
12. In a combination as set forth in claim 11,
the energy supply means constituting a battery.
13. In a combination as set forth in claim 11,
means connected to the capacitance for limiting the amplitude of the triggering signal.
14. In a combination as set forth in claim 13,
the energy supply means constituting a battery,
the first switching means including a pair of switches each having first and second operative relationships, one of the first switching means being connected across the firing means in the first operative relationship and the other connected across the energy storage means in the first operative relationship and both connected in a circuit with the firing means and the energy storage means and the second switching means in the second operative relationship of the switches in the pair and of the second switching means.
15. In a combination as set forth in claim 14,
the energy storage means including a capacitor and the second switching means including a transistor nonconductive in the first operative relationship and conductive in the second operative relationship.
16. In combination,
first and second ganged switching means each having first and second operative relationships,
firing means,
energy storage means,
the first ganged switching means being connected across the firing means in the first operative relationship to prevent the firing means from being fired and the second ganged switching means being connected across the energy storage means in the first operative relationship to prevent the energy storage means from being fired,
a battery connected to the energy storage means in the second operative relationship of the second switching means to transfer energy into the energy storage means, and
a transistor having conductive and non-conductive states, the transistor being connected in a circuit with the second switching means and the energy storage means to provide for a discharge of the energy storage means in the conductive state of the transistor,
means including a low pass filter for introducing a triggering signal to the transistor to change the transistor from a non-conductive state to a conductive state.
17. In a combination as set forth in claim 16,
the triggering means including a pair of terminals for receiving a triggering signal and also including a capacitor connected to the terminals for defining the low pass filter.
18. In a combination as set forth in claim 16,
the triggering means including a zener diode for regulating the amplitude of the triggering signal.
19. In a combination as set forth in claim 18,
the capacitor being charged upon the introduction of the triggering signal across the terminals,
the transistor being responsive to the charge in the capacitor to become conductive.
20. In a combination as set forth in claim 18,
the capacitor being charged through the low pass filter upon the introduction of the triggering signal across the terminals,
means including an impedance connected in a circuit with the battery and responsive to the charge in the capacitor for producing a voltage across the impedance,
the transistor being responsive to the voltage across the impedance for becoming conductive.
21. In a combination as set forth in claim 20,
the energy storage means constituting a second capacitor.
22. In a combination as set forth in claim 1,
shielding means enclosing the firing means, the energy storage means, the energy supply means, the first switching means, the second switching means and the triggering means to provide protection from external noise.
23. In a combination as set forth in claim 5,
shielding means enclosing the firing means, the first switching means, the energy supply means, the energy storage means, the second switching means and second means to provide protection from noise.
24. In a combination as set forth in claim 10,
shielding means enclosing the firing means, the energy storage means, the energy supply means, the first switching means, the second switching means, the first means, the second means and the third means to provide protection from noise.
25. In a combination as set forth in claim 16,
shielding means enclosing the first and second ganged switching means, the firing means, the energy storage means, the battery, the transistor and the means including the low pass filter to provide protection from external noise.

* * * * *